US006322864B1

(12) United States Patent
Fresnel

(10) Patent No.: US 6,322,864 B1
(45) Date of Patent: Nov. 27, 2001

(54) SLEEVE-TYPE ENVELOPE OF HEAT-SHRINKABLE PLASTIC MATERIAL FOR PACKAGING AT LEAST ONE ITEM

(75) Inventor: Eric Fresnel, Paris (FR)

(73) Assignee: Sleever International Company, Morangis (FR)

( * ) Notice: Subject to any disclaimer, the term of this patent is extended or adjusted under 35 U.S.C. 154(b) by 0 days.

(21) Appl. No.: 09/284,999

(22) PCT Filed: Dec. 10, 1996

(86) PCT No.: PCT/FR96/01966

§ 371 Date: May 19, 1999

§ 102(e) Date: May 19, 1999

(87) PCT Pub. No.: WO98/25834

PCT Pub. Date: Jun. 18, 1998

(51) Int. Cl.[7] ..... B65B 53/00

(52) U.S. Cl. ..... 428/34.9; 428/35.1; 428/35.2; 428/43; 428/74; 428/192; 206/497; 206/807; 215/246; 215/251

(58) Field of Search ..... 428/34.9, 35.1, 428/43, 76, 192, 35.2; 206/497, 807, 534; 215/246, 230, 232, 251

(56) References Cited

U.S. PATENT DOCUMENTS

| | | | | |
|---|---|---|---|---|
| 4,004,705 | * | 1/1977 | Fujio | 215/246 |
| 4,874,096 | * | 10/1989 | Tessera-Chiesa | 206/621 |
| 5,217,307 | * | 6/1993 | McClintock | 215/246 |
| 5,257,704 | * | 11/1993 | Gutt | 215/246 |
| 5,489,126 | * | 2/1996 | Gray, Jr. | 206/497 |
| 5,495,944 | * | 3/1996 | Lermer | 206/497 |
| 5,605,230 | * | 2/1997 | Marino, Jr. et al. | 206/534 |
| 5,788,076 | * | 8/1998 | Simmons | 206/459.5 |

FOREIGN PATENT DOCUMENTS

| | | | |
|---|---|---|---|
| 2 698 851 | | 6/1994 | (EP) . |
| 0 698 561 | | 2/1996 | (EP) . |
| 0 775 643 | | 5/1997 | (EP) . |
| 2698851 A1 | * | 6/1994 | (FR) . |

* cited by examiner

*Primary Examiner*—Rena L. Dye
(74) *Attorney, Agent, or Firm*—Nixon Peabody LLP; Stuart J. Friedman

(57) ABSTRACT

The envelope (100) has an additional flap (103) extending externally by superposition, being connected to the main portion (101) via two parallel lines of heat sealing (102, 105). According to the invention, the additional flap (103) has a reinforcing strip (106) applied thereto and at least one cutout (110) is formed therein to define the outline of a pull tongue (114). The cutout (110) extends beyond the reinforcing strip (106) in the form of two slots (113) formed through the wall of the flap and forming tear starters. The flap also has a line of perforations (104) extending parallel to the direction of the reinforcing strip (106) and at a distance therefrom, so as to enable the panel which is obtained by tearing the corresponding portion of said flap to be detached.

17 Claims, 5 Drawing Sheets

SLEEVE-TYPE ENVELOPE OF HEAT-SHRINKABLE PLASTIC MATERIAL FOR PACKAGING AT LEAST ONE ITEM

FIELD OF THE INVENTION

The invention relates to wrapping articles, and in particular to packaging consumer goods such as foodstuffs, chemicals, cosmetics, or pharmaceuticals, which generally require consumer or user information, or indeed other information of a purely commercial nature.

More precisely, the invention relates to an envelope for wrapping at least one article such as a container, which wrapping is of the type constituted by a sleeve of heat-shrink plastics material suitable for closely surrounding at least a portion of the article, and also having an additional flap extending externally by superposition, being connected at its ends to the main portion of the sleeve via two parallel lines of heat sealing. Such a sleeve of heat-shrink plastics material serves in general to form a medium for carrying information and/or for preventing relative motion of opening and closing means (when the article is a container). The additional flap is designed in theory to be removable, and it then serves to provide additional specific information presented on the flap itself, or else on an explanatory sheet placed in the pocket formed by the flap in association with the main portion of the sleeve.

BACKGROUND OF THE INVENTION

An envelope of that type is described in the Applicants' document FR-A-2 698 851. In that known envelope, the additional flap is integral with the sleeve, and it is connected to the sleeve proper via two parallel lines of heat sealing which extend along generator lines of the sleeve, said lines of heat sealing defining the length of said flap.

The above-mentioned document provides tear means such as perforations disposed in two lines that are parallel to the generator lines of the sleeve and close to the two ends of the flap. The tear means must enable the additional flap to be detached easily without spoiling the sleeve in the separation zone where the flap is detached from the sleeve. It is possible to provide for the use of adhesive means instead of tear means, however it turns out that use of such adhesive means is difficult in practice.

Furthermore, the envelope shown in the above-mentioned document is suitable only for removing the additional flap in full, and not for removing a portion only thereof.

The above-mentioned document is a good illustration of the state of the art concerning the use of an envelope made of heat-shrink plastics material and having an additional flap provided with an explanatory sleeve disposed in the pocket formed by the flap and the sleeve. Nevertheless, it may be desired to use an additional flap forming an extension of an envelope for wrapping articles in some other way, and this is particularly true when it is desired to organize a coupon system in which one or more coupons can be detached from the envelope, e.g. for use as vouchers for immediate repayment or as vouchers for obtaining a price reduction when purchasing some other goods.

The state of the art relating to such use is well illustrated by document WO 92/02421 which shows a card envelope that is extended by an additional flap which terminates in a pull tongue that serves to break spots of adhesive organized vertically up the free end edge of the flap, so that the entire flap can finally be detached with the help of a line of perforations provided at the other end of said flap.

Nevertheless, that technique is suitable only for envelopes made of reinforced paper or of card, and its teaching cannot be used for envelopes made out of a film of heat-shrink plastics material. If it were envisaged to use the same envelope structure with a heat-shrink plastics material, then two difficulties would be encountered: firstly it would be necessary to organize appropriate heat sealing along the free edge of the additional flap (capable of withstanding tensile forces encountered during shrinking), and then the pull tongue would need to be very thick, firstly to enable the line of heat sealing to be broken, and secondly to be strong enough to withstand deformation when the envelope is passed through the oven for shrinking said envelope.

Reference can also be made to document U.S. Pat. No. 4,318,235 which describes a paper label whose wall has a cutout enabling a central rectangular panel to be detached. In addition to the fact that the cylindrical envelope formed by the label does not have a flap, the teaching of that document is unusable for making an envelope out of heat-shrink plastics material since the cutout in question would not withstand shrinking forces.

Finally, the state of the art is also illustrate by documents U.S. Pat. No. 1,686,354 and BE-A-506 116.

BRIEF SUMMARY OF THE INVENTION

An object of the invention is to improve envelopes of the type described in document FR-A-2 698 851, conserving an additional flap arrangement that makes one or more portions of the flap easy to detach without damaging the sleeve, and while nevertheless withstanding shrinkage forces.

Another object of the invention is to design an envelope that can be used not only for wrapping a single article, but also for wrapping a group of articles by means of a sleeve having a plurality of compartments, in particular a sleeve made in accordance with the Applicants' document FR-A-2 637 866.

More particularly, the invention provides an envelope for wrapping at least one article, the envelope being of the type constituted by a sleeve of heat-shrink plastics material suitable for having a main portion for closely surrounding at least a portion of a single article if there is only one article, or of a group of articles if there is a plurality of articles, said sleeve also having an additional flap extending externally by superposition and being connected at its ends to the main portion of the sleeve via two parallel lines of heat sealing, wherein the additional flap has at least one reinforcing strip fitted thereto in which at least one cutout is formed to define the outline of a pull tongue whose sides extend substantially perpendicularly to the direction of the reinforcing strip, the or each cutout extending beyond said reinforcing strip in the form of two slots formed through the wall of the flap and forming tear starters, said flap also having a line of perforations or the like extending in a direction substantially parallel to the direction of the reinforcing strip and at a distance therefrom, to make it possible to detach the panel that is obtained by tearing the corresponding portion of said flap by pulling on the associated tongue.

By means of the reinforcing strip, the end of the cutout tongue thus has all of the required qualities of strength and permanence after shrinking. In addition, it becomes possible to organize the positioning and the shape of the cutout with a very wide degree of freedom, and also to provide a multi-part cutout or a plurality of separate cutouts for generating a plurality of tongues, each enabling an individual panel to be detached, in a system of detachable coupons.

In a first embodiment, the or each reinforcing strip extends along a generator line of the sleeve, e.g. by being disposed in the vicinity of one of the two lines of heat sealing connecting the additional flap to the main portion of the sleeve. The reinforcing strip can be single, extending over the full height of the sleeve, as does the line of perorations or the like under such circumstances, or else it can be made in the form of disjoint segments in alignment on a common generator line of the sleeve.

In another embodiment, the or each reinforcing strip extends along a circumferential direction of the sleeve, e.g. being disposed in the vicinity of the top edge or the bottom edge of the sleeve. In this case also, the reinforcing strip can be single, and extend over the available length of the additional flap between the two lines of heat sealing connecting said flap to the main portion of the sleeve, as does the line of perforations or the like under such circumstances, or else it can be organized as a plurality of separate strip segments in alignment on a common circumferential line of the sleeve.

Preferably, the or each reinforcing strip is placed against the inside face of the additional flap. In addition to discretion when the reinforcing strip is colored and the film of the flap is transparent, placing the reinforcing strip against the inside face of the flap makes it possible to provide printing on the outside face of the or each tongue.

As mentioned above, applying traction to the or each tongue enables one or more panels to be detached that are obtained by tearing the corresponding portion of the additional flap, with it being possible to organize said tearing in an axial direction or in a circumferential direction. Nevertheless, when the film constituting the sleeve is of considerable thickness (e.g. greater than 100 $\mu$m), it can be advantageous to provide assistance in tearing the wall of the additional flap so that the panel is opened in uniform manner. To this end, it can be advantageous to provide for the additional flap to have lines of microperforations connecting each extension slot to the line of perforations or the like.

The or each panel can be printed on the front and/or on the back. It would naturally be possible to provide a single additional flap having a plurality of adjacent panels, of sizes that may be identical or different.

Preferably, the film constituting the sleeve is mono-oriented, in a longitudinal direction or in a transverse direction, and the or each reinforcing strip then extends respectively circumferentially or axially. This single orientation contributes to making the film suitable for tearing in the intended direction, which corresponds to tearing the additional flap progressively when traction is exerted on the associated tongue, said suitability being the result of the molecular chain of the material constituting the film lengthening during the stretching operation.

The cutout formed in the wall of the additional flap at the reinforcing strip with its two slot-shaped extensions extending beyond said reinforcing strip is preferably performed flat, i.e. before the envelope is shaped to form a sleeve, and the two lines of heat sealing securing the additional flap to the main portion of the envelope has been implemented. Nevertheless, it can be advantageous to make the cutout(s) after the envelope has already been shaped. However, under such circumstances, cutting out runs the risk of weakening the zone of the main portion of the sleeve in register with the cutout zone of the additional flap. Under such circumstances, it is advantageous to provide local reinforcement for the main portion of the envelope so as to make it possible to use an anvil with a knife whose blade has the outline of the desired cutout, forming a specific tool which is a function of the corresponding need. According to another characteristic of the invention, provision is then made for the main portion of the sleeve also to have at least one reinforcing strip disposed in such a manner that the or each reinforcing strip of the additional flap is superposed thereover, so as to provide additional reinforcement while the cutout(s) is/are being formed on the envelope after it has already been formed.

Finally, it is also preferable for the or each reinforcing strip to be made of plastics material from a film that is mono-oriented in a determined direction, said reinforcing strip(s) being obtained in such a manner that the longitudinal direction of the strip(s) is parallel to said determined direction. This avoids any undesirable transverse shrinking of one or other reinforcing strip.

BRIEF DESCRIPTION OF THE DRAWINGS

Other characteristics and advantages of the invention will appear more clearly in the light of the following description and the accompanying drawings relating to particular embodiments, and with reference to the figures in which.

DETAILED DESCRIPTION OF THE INVENTION

Figure 1:
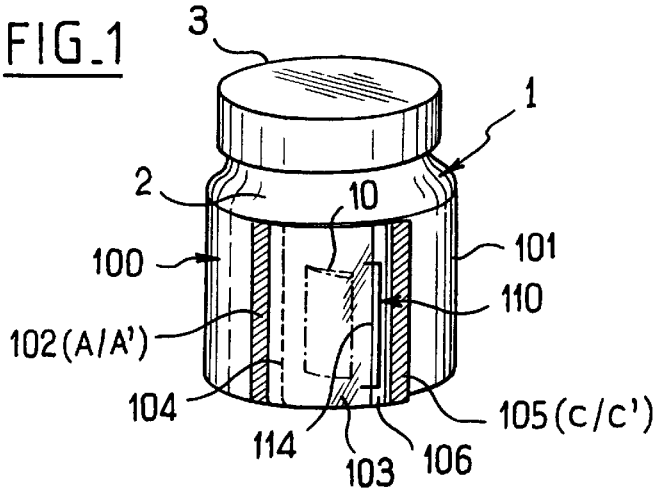
FIG. 1 is a perspective view of a container wrapped with an envelope of the invention, in which the additional flap holds a sheet in the pocket it forms with the sleeve, the tongue cut out from the flap still being in place in this case against the main portion of the sleeve.

FIG. 1 shows a container 1 wrapped in an envelope of the invention referenced 100. The container 1 comprises a body 2 and a closure cap 3, and the wrapping envelope 100 surrounds the body of the container closely due to it being heat-shrunk thereon. Such a container is naturally given merely by way of example, in order to illustrate a particular case of an article that can be wrapped by means of an envelope of the invention.

The envelope 100 is constituted by a sleeve of heat-shrink plastics material, and it has a main portion 101 that closely surrounds the body of the container 1, together with an additional flap 103 extending externally by superposition and connected at its two ends to the main portion 101 of the sleeve via two parallel lines of heat sealing 102 and 105. Specifically, the additional flap 103 co-operates with the main portion 101 of the sleeve to define a pocket in which a sheet 10 is inserted. The envelope l00 thus has a first line of heat sealing 102 which extends along a generator line of the cylinder formed by said sleeve, and the additional flap 103 extends externally from said line of heat sealing 102 to a second line of heat sealing 105 which also extends along a generator line of the cylinder.

To gain access to the sheet 10 housed in the associated pocket, it is necessary to detach at least a portion of the additional flap 103. To this end, a pull tongue is provided that is formed by means of a special cutout, and that enables a panel to be formed by tearing until a line of perforations or the like is reached enabling the torn panel finally to be separated.

Figure 2:
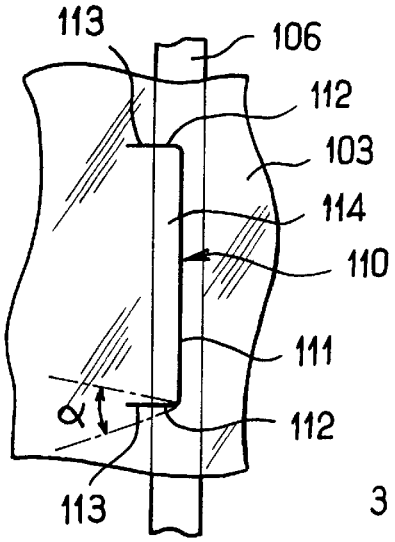
FIG. 2 is a fragmentary plan view showing the zone of the tongue formed by the cutout, with its two extension slots extending beyond the holding strip which is shown by transparency.

Thus, and in accordance with an essential characteristics of the invention, the additional flap 103 has a reinforcing strip 106 applied thereto, with a cutout 110 being formed in the strip to define the outline of a pull tongue 114 whose side edges extend substantially perpendicularly to the direction in which the reinforcing strip 106 extends. The detail of FIG. 2 shows more clearly how the cutout 110 is organized. The cutout 110 passes through the wall of the flap and through the reinforcing strip 106 which is associated therewith, thus having a main segment 111 extending in the same direction as the reinforcing strip 106 followed by two lateral segments 112 extending from the ends of the central segment 111, said lateral segments also extending through the reinforcing strip 106. The lateral segments 112 shown herein extend perpendicularly to the central segment 111. Nevertheless, it is possible to use an angle that is less than or greater than 90°, as shown diagrammatically in FIG. 2 by a range of angles referenced $\alpha$. In practice, the segments 111 and 112 form between them an angle that lies in the range 80° to 120°. This makes it clear that the term "substantially perpendicularly" as used above should under no circumstances be understood strictly, but on the contrary should be understood as covering a certain range of angles on either side of that which can be considered as a general direction.

In addition, the cutout 110 extends beyond the reinforcing strip 106 in the form of two slots 113 formed through the wall of the additional flap 103. The end portion of the tongue 114 formed in this way is thus lined with the cutoff portion of the reinforcing strip 106, thereby guaranteeing the necessary qualities of strength and permanence before and after said pull tongue is shrunk. The two slots 113 formed through the wall of the flap 103 beyond the reinforcing strip 106 thus form tear starters. The additional flap 103 also has a line of perforations or the like 104 extending in a direction substantially parallel to the direction of the reinforcing strip 106 and at a distance therefrom.

Figure 3:
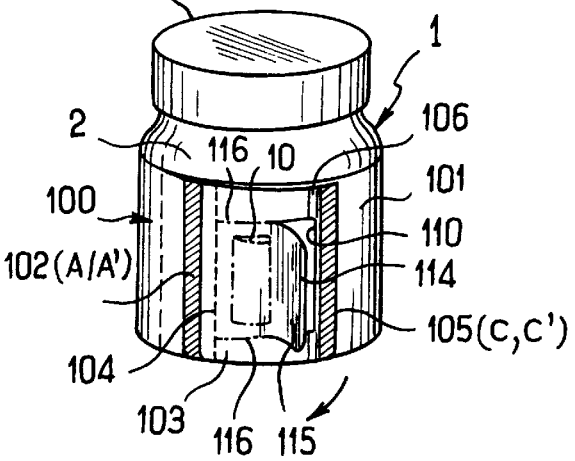
FIGS. 3 and 4 show how the panel is progressively separated by tearing the corresponding zone of the additional flap until the resulting panel has been separated and the previously held sheet has been released.
Figure 4:
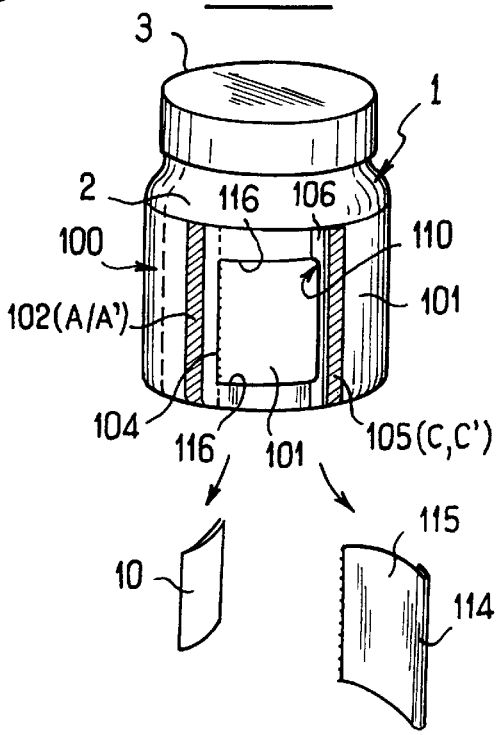

It is then possible to detach a panel 115 which is obtained by tearing the corresponding portion of the flap 103, said tearing being performed by pulling on the associated tongue 114. In FIG. 3, the tongue 114 has begun to be pulled and part of the corresponding portion of the additional flap 103 has been torn, thereby lengthening the two extension slots 113, with the lines of tearing to be followed being represented by chain-dotted lines 116. In FIG. 4, the panel 115 has been completely disengaged by tearing the wall of the flap as far as the line of perorations 104, thereby enabling the panel to be detached, and also enabling the explanatory sheet 10 which was previously held captive to be removed.

Figure 5:
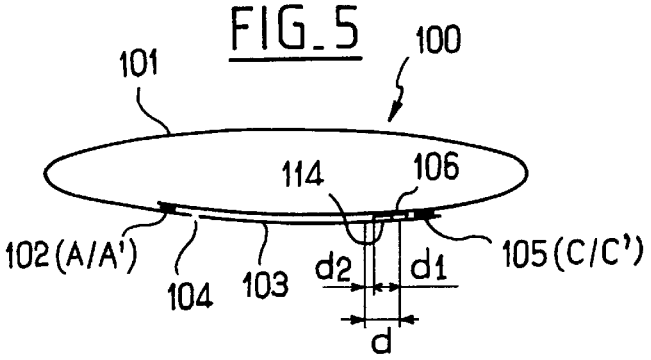
FIG. 5 is an end view of the envelope of FIGS. 1 to 4 after it has been shaped, and prior to being put into place on the container and heat-shrunk thereon.

The end view of FIG. 5 shows the envelope 100 with its two lines of heat sealing 102, 105 and its line of perforations or the like 104 formed through the additional flap 103. In this case, the reinforcing strip 106 is placed against the inside face of the additional flap 103 which is advantageous but not essential in any way. The width of the cutout (in a circumferential direction) is referenced d, a portion thereof d1 extending in the width of the reinforcing strip 106, and another portion thereof d2 extending through the wall of the flap 103 beyond the reinforcing strip 106 (this portion d2 corresponding to the above-mentioned extension slots 113).

Figure 6:
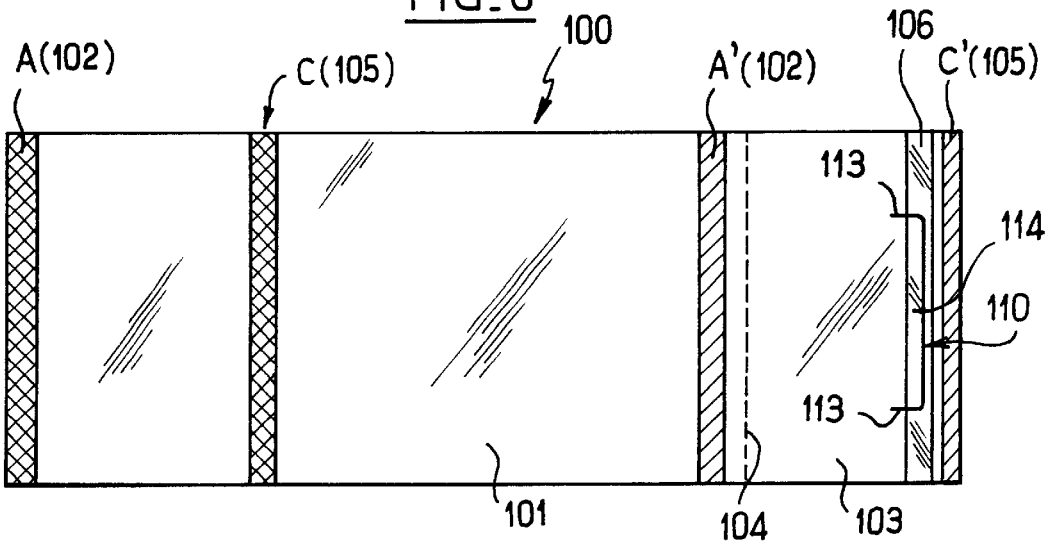
FIG. 6 is a plan view showing the developed inside surface of the envelope.

The view of FIG. 6 shows the developed inside surface of the above-mentioned envelope 100, showing firstly the main portion 101 with its two zones referenced A and A' associated with the line of heat sealing 102, and its two zones referenced C and C ' associated with the line of heat sealing 105. The additional flap 103 can also be seen connected to the main portion 101 of the envelope via the line of perforations 104, which additional flap has a terminal zone C' associated with the above-mentioned zone C to form the line of heat sealing 105. As will readily be understood, when the envelope 100 is shaped, the zones A and A' are superposed to form the line of heat sealing 102, and the zones C and C' are superposed to form the line of heat sealing 105. The reinforcing strip 106 can also be seen with the cutout 110 formed therein and extended at each end by the two slots 113 that apply solely to the wall of the additional flap 103 beyond the reinforcing strip 106. In FIG. 6, the zones A' and C' are shaded to show that these zones are on the inside face of the wall, whereas the zones A and C are cross-hatched to show that these zones are behind the wall of the envelope and are thus shown in transparency.

The embodiment described above constitutes one particular implementation of the invention and it is possible to envisage numerous variants within the ambit of the invention.

Thus, it is possible to place the reinforcing strip at another location of the additional flap, and possibly in a different direction. It is also possible to provide a reinforcing strip made up of disjoint segments. As for the cutout, it may be of various shapes and sizes; the cutout may be a multi-part cutout, being organized as successive cutouts so as to have a plurality of tongues enabling a corresponding number of detachable panels or coupons to be generated.

Some of those variants are shown in FIGS. 7 to 11, in which the same references have been retained for corresponding elements, thereby enabling these figures to be described more quickly.

Figure 7:
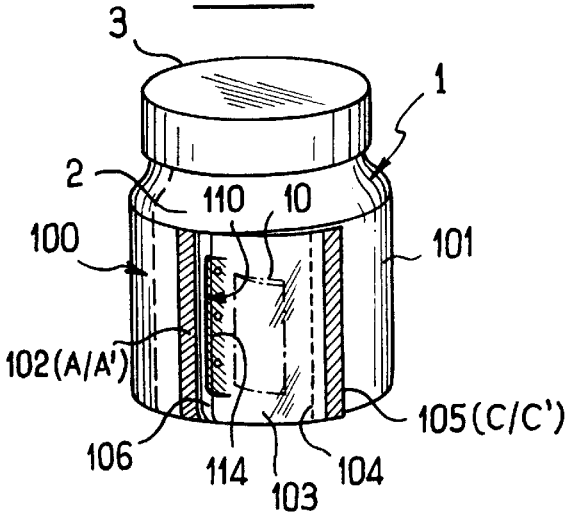
FIG. 7 shows a variant in which the reinforcing strip is not provided in the vicinity of the end edge of the additional flap, but in the vicinity of its other edge so that traction is now applied from left to right in order to tear open the panel.

FIG. 7 shows a variant in which the positions of the reinforcing strip 106 and of the line of perforations or the like 104 are interchanged relative to the preceding variant. In this case, the tongue 114 that results from the cutout formed in the reinforcing strip 106 is disposed in such a manner that the panel is formed by tearing the corresponding zone of the additional flap 103 from left to right, i.e. in a direction opposite to that for the preceding variant. In addition, as in the preceding variant, the reinforcing strip 106 is disposed on the inside face of the additional flap 103, thus making it possible in particular to provide printing on the outside face of the tongue 114, as shown diagrammatically in FIG. 7.

Figure 8:
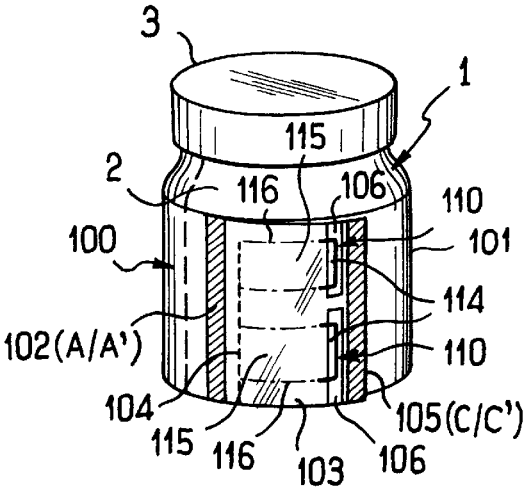
FIG. 8 shows another variant in which the reinforcing strip is made in the form of two disjoint segments, and two tongues are provided enabling two disjoint panels to be torn from the corresponding zones of the additional flap.

In FIG. 8, the strip 106 is constituted by a plurality of disjoint segments, two in this case, these segments being preferably in alignment on a common generator line of the sleeve. Each of the segments has a cutout 110 of the same type as the cutout in the preceding variant, except that it relates to a possibly smaller height of the sleeve, so as to provide two pull tongues 114. Each tongue 114 serves to generate a panel or coupon 115 by tearing the wall of the additional flap 103, with tearing naturally being started by the extension slots of each of the cutouts 110, these slots themselves being extended during tearing along lines drawn as chain-dotted lines 116 when the wall of the flap is torn to form each of the two panels 115.

Figure 9:
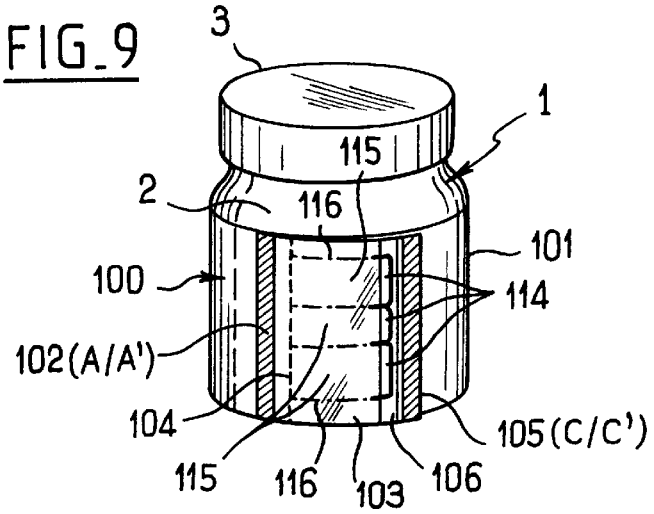
FIG. 9 shows a variant in which the (single) reinforcing strip is disposed along a circumferential direction of the sleeve, such that the various panels are torn away from the additional flap in a vertical direction, in this case downwards.

FIG. 9 shows another variant that differs from the preceding variant in that the reinforcing strip 106 (a single strip) now has a multi-part cutout 110 enabling three tongues 114 to be generated which are directly contiguous with one another. In this case, the three panels or coupons 115 that can be obtained by pulling on the respective tongues 114, with corresponding tearing of the wall of the additional flap 103 are directly adjacent, i.e. some of the lines 116 are common to two adjacent flaps. This makes it possible to provide a genuine system of multiple detachable coupons.

Figure 10:
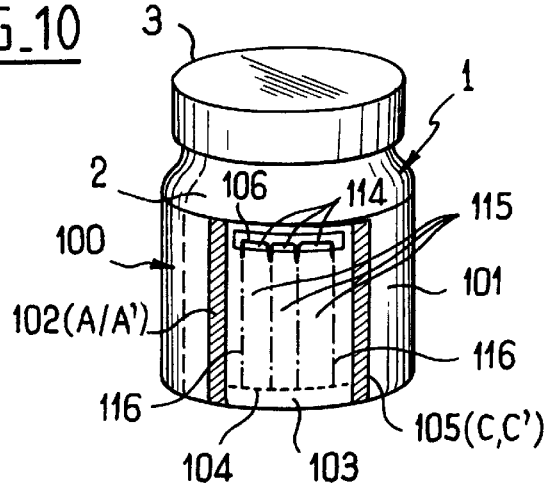
FIG. 10 shows another variant in which the single reinforcing strip has three cutouts forming three tongues side by side ready for generating three directly adjacent detachable panels or coupons.
Figure 11:
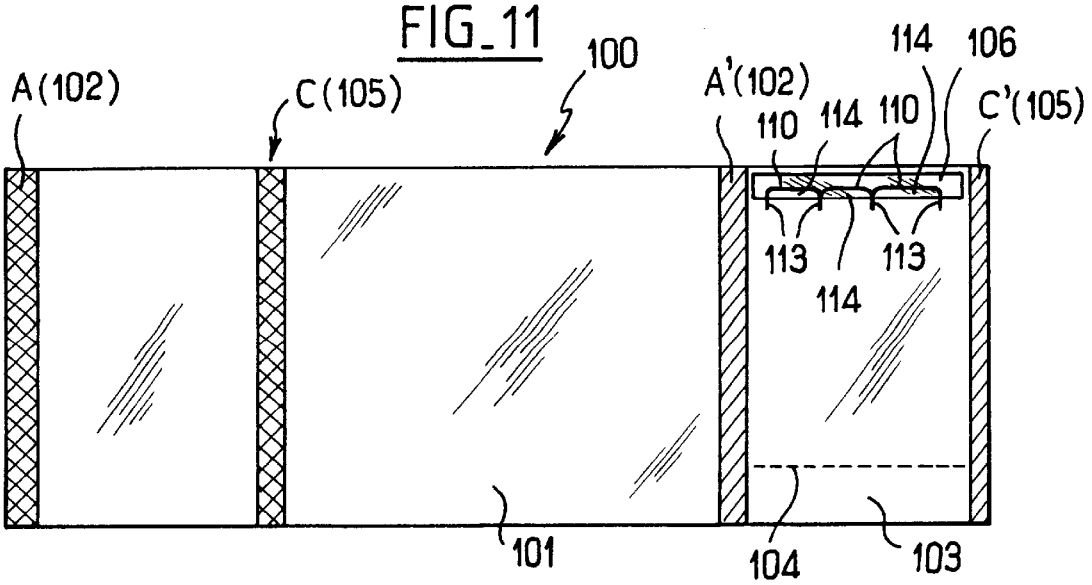
FIG. 11 is a plan view of the developed inside surface of the envelope corresponding to FIG. 10.

FIG. 10 shows another variant in which the reinforcing strip 106 no longer extends along a generator line of the sleeve, but along a circumferential direction of said sleeve. This reinforcing strip 106 (a single strip in this case) could naturally also be organized as successive segments extending along a circumferential line. At least one cutout 110 is provided (three contiguous cutouts forming a three-part cutout in this case) to enable one or more panels 115 to be obtained by tearing the wall of the additional flap 103, said tearing then taking place along lines 116 which now extend along generator lines of the sleeve, with the line of perforations 104 now being disposed accordingly, i.e. along a circumferential direction. It is possible to detach any of the panels 115 in the form of individual coupons, in this case by pulling downwards. Naturally, in a variant, the reinforcing strip 106 could still be provided along a circumferential direction, but in the vicinity of the bottom edge of the sleeve, in which case each of the panels would be detached by pulling the corresponding tongue 114 upwards. The developed view of FIG. 11 shows more clearly how the envelope of FIG. 10 is organized with its reinforcing strip 106 extending lengthwise relative to the flap envelope, the line of perforations 104 being parallel to said reinforcing strip 106 and being located close to the edge thereof that is remote from the portion of the envelope corresponding to the additional flap 103.

When a single reinforcing strip is used that extends along a generator line of the sleeve, this strip preferably extends over the full height of the sleeve, as does the line of perforations or the like, thereby considerably simplifying manufacture. Under such circumstances, a continuous film is used that is coated with a ribbon that is paid out and corresponds to the reinforcing strip, the film being cut up transversely into segments that correspond to the height desired for the sleeve. In like manner, when a single reinforcing strip is used which extends along a circumferential direction of the sleeve, the reinforcing strip preferably extends along the available length of the additional flap between the two lines of heat sealing that connect said flap to the main portion of the sleeve, as does the line of perforations or the like. By using the maximum available length for the reinforcing strip, it is possible to dimension and/or position the cutouts at will depending on requirements.

As mentioned above, the cutouts can be made either while the envelope is flat, or else after the envelope has already been shaped, i.e. after the two parallel lines of heat sealing have been formed. Making the cutout(s) in the envelope while it is flat presents no particular difficulty. However, if it is desired to make the cutouts on the envelope after it has been shaped, there is a risk of marking the outside wall of the main portion of the sleeve by contact with a portion of the cutting tool used for making the cutout(s) in the additional flap. That would then run the risk of generating localized marks or fissures in the main portion, and fissures are highly undesirable insofar as they will naturally grow during shrinkage of the envelope on the article, thereby giving rise to an unacceptable risk of breakage. To avoid this drawback, it is advantageous to provide for the main portion of the sleeve to have its own reinforcing strip. One such variant is such in FIGS. 12 to 14.

Figure 12:
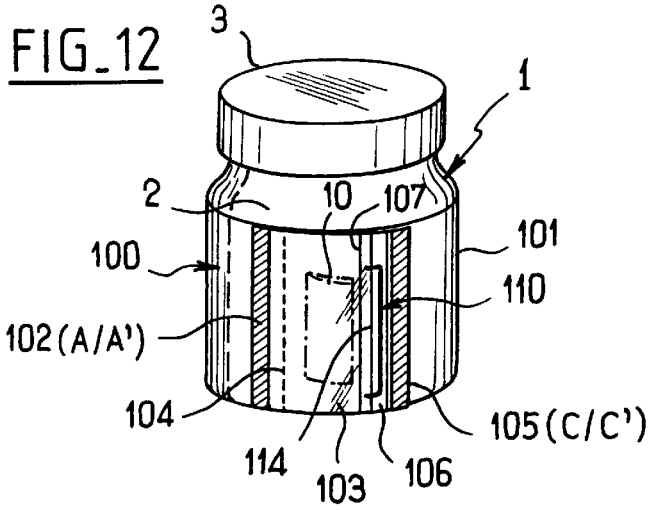
FIG. 12 shows another variant in which the main portion of the sleeve is also fitted with a reinforcing strip.
Figure 13:
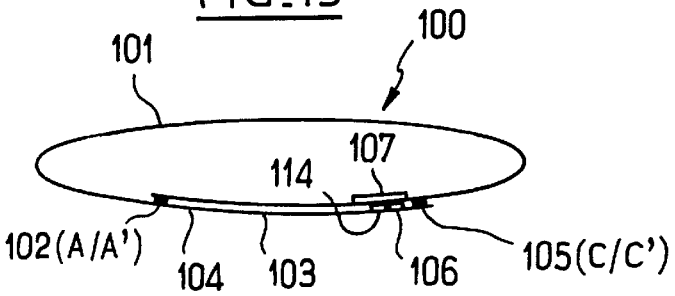
FIG. 13 is an end view of the FIG. 12 envelope after it has been shaped, and prior to being put into place on the container and heat-shrunk thereon.
Figure 14:
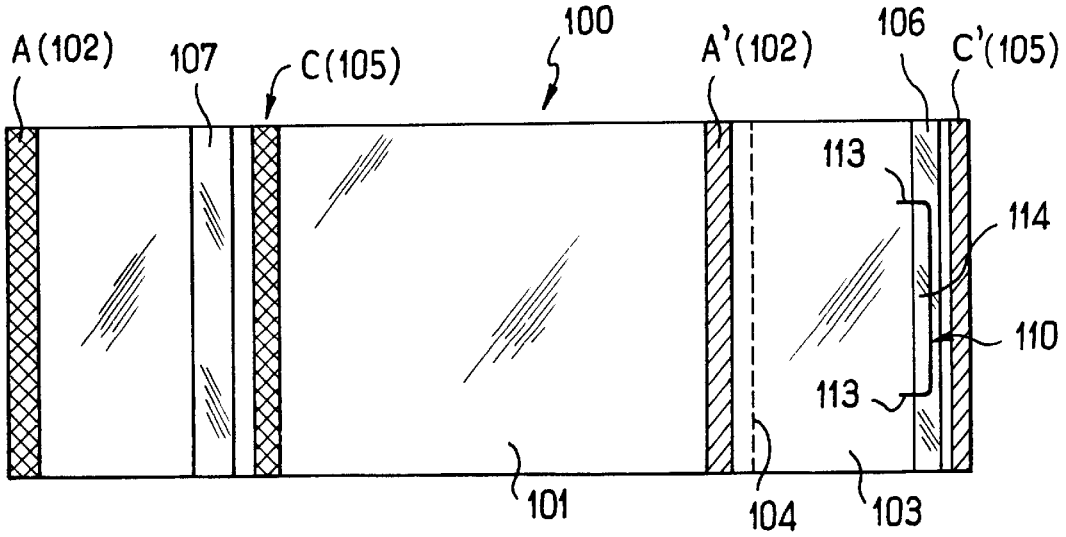
FIG. 14 is a plan view of the developed outside surface of the envelope of FIGS. 12 and 13.
Figure 15:
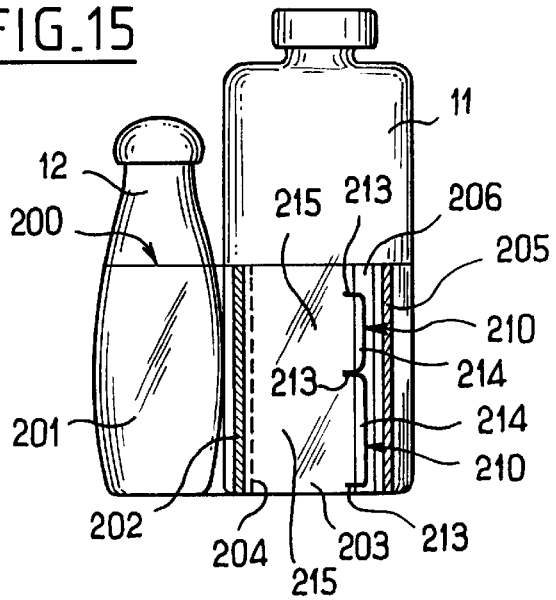
FIGS. 15 and 16 are a diagrammatic elevation view and plan view of a group of two containers wrapped in an envelope of the invention, said envelope in this case being a two-compartment envelope.

The envelope shown in FIGS. 12 to 14 differs from the envelope of FIGS. 1 to 6 solely by the presence of a reinforcing strip 107 on the main portion 101 of the sleeve, this reinforcing strip 107 being disposed in such a manner that the or each reinforcing strip 106 of the additional flap 103 is superposed thereon. This provides additional reinforcement while the cutout(s) 110 is/are being formed in an envelope that has already been shaped. A reinforcing strip 107 is shown placed against the inside wall of the main portion 101, however it would naturally be possible to place it on the outside wall. In addition, if the reinforcing strip 106 is implemented in the form of disjoint segments, it would also be possible to make the secondary reinforcing strip 107 in the form of separate segments, naturally providing that said segments overlap the segments 106 so as to provide the above-mentioned reinforcing function.

In any event, it is advantageous to provide for the reinforcing strip(s) 106, 107 to be made of a plastics material using a mono-oriented film extending in a determined direction, with the reinforcing strip(s) then being obtained in such a manner that their own longitudinal direction is parallel to said predetermined direction.

This avoids any transverse shrinkage of the reinforcing strip(s) while the envelope is being shrunk. As an indication, the reinforcing strips 106, 107 can be made of polyethylene, polypropylene, or polyethylene terephthalate.

In addition, the film constituting the sleeve is preferably mono-oriented in a longitudinal direction or a transverse direction, and the or each reinforcing strip 106 then extends respectively circumferentially or axially. This makes elegant use of the elongation of the molecular chains of the film that results from the mono-orientation for the purpose of facilitating the tearing which is performed in the direction in which the film is oriented, thereby facilitating the formation of one or more panels. In contrast, the reinforcing strip retains all of its strength.

The or each panel 115 can be printed recto and/or verso. When there are a plurality of adjacent panels, they could naturally be identical in size or different, thereby giving a great degree of freedom in organizing a coupon system.

The invention applies not only to wrapping a single article as described above, but also to wrapping a group of articles by means of a sleeve having a plurality of compartments, in particular a sleeve made in accordance with the Applicants' document FR-A-2 637 866. That document describes a certain number of sleeves having a plurality of compartments, and in particular a sleeve of the type shown in FIGS. 15 to 18 for the organization of two such compartments.

FIGS. 15 to 18 thus show an envelope 200 of the invention for wrapping a group of two containers 11, 12. To simplify the description, portions which are identical to or analogous to portions of the above-described envelope 100 are given the same references plus 100, and they are not described again.

Figure 16:
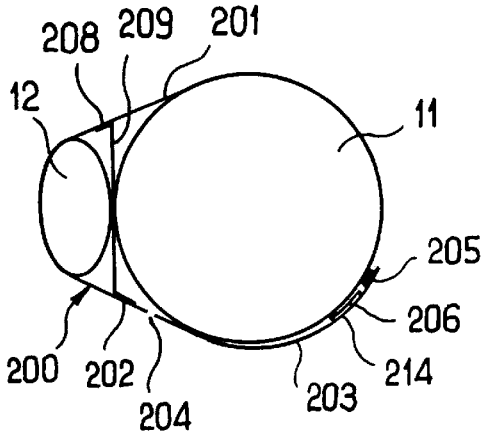
Figure 17:
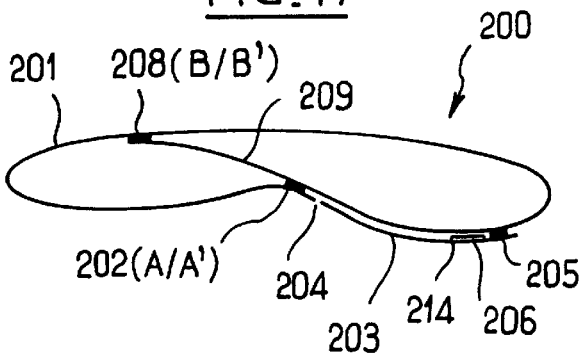
FIG. 17 is an end view of the envelope of FIGS. 15 and 16 after it has been shaped, and before it has been put into place on the two containers and heat-shrunk thereon.
Figure 18:
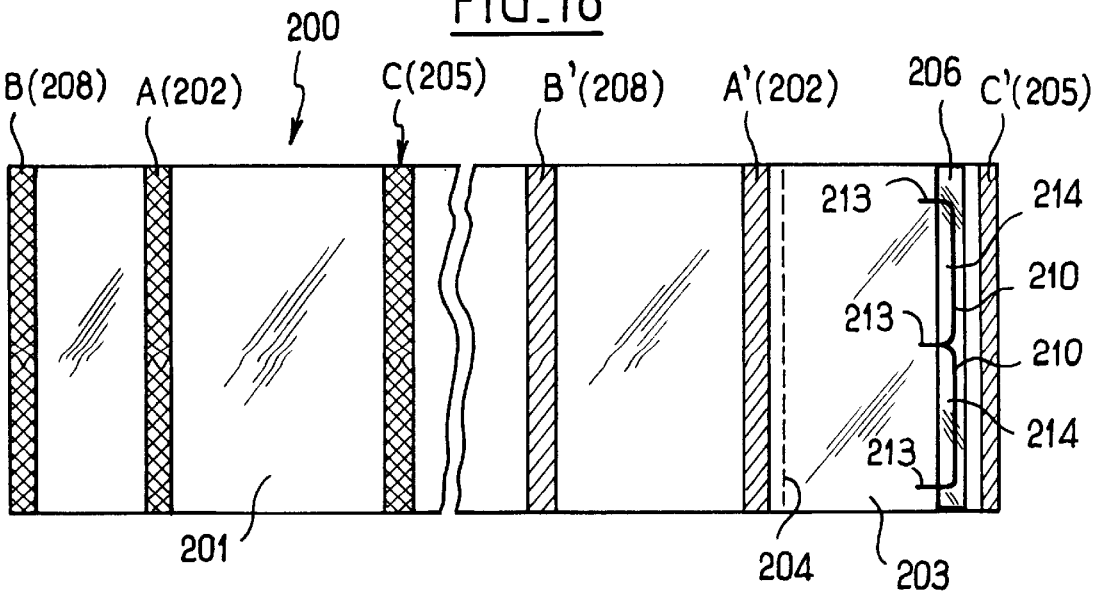
FIG. 18 is a plan view of the developed inside surface of the envelope of FIGS. 15 to 17.

For a two-compartment sleeve, a second line of heat sealing 208 is provided at a distance from the first line of heat sealing 202 so as to define an intermediate membrane 209. The line 208 is naturally parallel to the line 202, and FIGS. 16 and 17 show more clearly the shape taken by said envelope 200 respectively when in place and shrunk onto the two objects 11 and 12, and prior to being engaged on those two objects. The developed view of FIG. 18 thus shows more clearly the zones B, B' associated with forming the second line of heat sealing 208. There can also be seen the zones A, A' associated with the first line of heat sealing 202 and the zones C, C' associated with the line of heat sealing 205, as for the preceding sleeve that wraps a single article. Otherwise, the organization of the additional flap 203 with its line of perforations 204 and its reinforcing strip 206, and with its tongue(s) 214 resulting from the cutout(s) 210 in said reinforcing strip 206. As before, it is thus possible to form a plurality of panels or coupons 215 (in this case two of them) that can be detached by tearing (in this case in a circumferential direction) by exerting traction on the corresponding tongue 214.

Naturally, the variants described above with reference to FIGS. 7 to 14 can be transposed to envelopes having a plurality of compartments, and in particular for the two-compartment envelope of FIGS. 15 to 18.

It has thus been possible to make an envelope in which the additional flap can generate one or more panels or coupons which are detachable by exerting traction on a corresponding tongue which is both strong and permanent, and with minimum force being required for tearing. The multiple options available for organizing and dimensioning the cutouts that generate the tongues make it possible to adapt to numerous different situations depending on requirements.

The invention is not limited to the two embodiments described above, but on the contrary covers any variant using equivalent means to reproduce the essential characteristics specified above.

What is claimed is:

1. An envelope (100; 200) for wrapping at least one article, the envelope being constituted by a sleeve of heat-shrink plastics material having a main portion (101; 201) for closely surrounding at least a portion of a single article containing a single article, or of a group of articles containing a plurality of articles, said sleeve also having an additional flap (103; 203) extending externally by superposition and being connected at its ends to the main portion of the sleeve via two parallel lines of heat sealing (102, 105; 202, 205), wherein the additional flap (103; 203) has at least one reinforcing strip (106; 206) fitted thereto, at least one cutout (110, 210) being formed in said flap to define the outline of a pull tongue (114; 214) whose sides extend substantially perpendicularly to the direction of the reinforcing strip (106; 206), the or each cutout (110; 210) extending beyond said reinforcing strip in the form of two slots (113; 213) formed through the wall of the flap and forming tear starters, said flap also having a line of perforations (104; 204) extending in a direction substantially parallel to the direction of the reinforcing strip (106; 206) and at a distance therefrom, to make it possible to detach the panel (115; 215) that is obtained by tearing the corresponding portion of said flap by pulling on the associated tongue (114; 214).

2. An envelope according to claim 1, wherein the or each reinforcing strip (106; 206) extends along a generator line of the sleeve.

3. An envelope according to claim 2, wherein the or each reinforcing strip (106; 206) is placed in the vicinity of one of the two lines of heat sealing (102, 105; 202, 205) connecting the additional flap (103; 203) to the main portion (101; 201) of the sleeve.

4. An envelope according to claim 2 or 3, wherein the reinforcing strip (106; 206) is single strip and extends over the entire height of the sleeve, as does the line of perforations (104; 204).

5. An envelope according to claim 1, wherein the or each reinforcing strip (106) extends along a circumferential direction of the sleeve.

6. An envelope according to claim 5, wherein the or each reinforcing strip (106) is placed in the vicinity of the top edge or the bottom edge of the sleeve.

7. An envelope according to claim 5 wherein there is a single reinforcing strip (106) which extends along the available length of the additional flap (103) between the two lines of heat sealing (102, 105) connecting said flap to the main portion (101) of the sleeve, as does the line of perforations (104).

8. An envelope according to claim 1, wherein the or each reinforcing strip (106; 206) is placed against the inside face of the additional flap (103; 203).

9. An envelope according to claim 8, wherein the or each tongue (114; 214) is printed on its outside face.

10. An envelope according to claim 1, wherein the additional flap (103) has lines of microperforations (116) connecting each of the extension slots (113) to the line of perforations or the like (104), in particular when the film constituting the sleeve is thick.

11. An envelope according to claim 1, wherein the or each panel (115; 215) is printed recto.

12. An envelope according to claim 1, wherein a plurality of adjacent panels (115; 215) are provided, of sizes that are identical or different.

13. An envelope according to claim 1, wherein the film constituting the sleeve is mono-oriented, in a longitudinal direction or in a transverse direction, and the or each reinforcing strip (106; 206) then extends respectively circumferentially or axially.

14. An envelope according to claim 1 wherein the main portion (101) of the sleeve also has at least one reinforcing strip (107) disposed in such a manner that the or each reinforcing strip (106) of the additional flap (103) is superposed thereover to provide additional reinforcement when the or each cutout (110) is formed on the envelope after it has been put into shape.

15. An envelope according to claim 1, wherein the or each reinforcing strip (106, 107; 206) is made of plastics material from a film that is mono-oriented in a determined direction, the or each reinforcing strip being obtained in such a manner that the longitudinal direction of the strip(s) is parallel to said determined direction.

16. An envelope according to claim 1, wherein the or each panel (115; 215) is printed verso.

17. An envelope according to claim 1, wherein the or each panel (115; 215) is printed recto and verso.

* * * * *